US010204541B2

(12) United States Patent
Kawashima et al.

(10) Patent No.: US 10,204,541 B2
(45) Date of Patent: Feb. 12, 2019

(54) DISPLAY AND DRIVE METHOD THEREOF

(71) Applicant: KUNSHAN GO-VISIONOX OPTO-ELECTRONICS CO., LTD., KunShan (CN)

(72) Inventors: Singo Kawashima, KunShan (CN); Xiujian Zhu, KunShan (CN); Xiaozhao Zhu, KunShan (CN); Long Wang, KunShan (CN)

(73) Assignee: KUNSHAN GO-VISIONOX OPTO-ELECTRONICS CO., LTD., KunShan (CN)

( * ) Notice: Subject to any disclaimer, the term of this patent is extended or adjusted under 35 U.S.C. 154(b) by 0 days.

(21) Appl. No.: 15/537,272

(22) PCT Filed: Dec. 24, 2015

(86) PCT No.: PCT/CN2015/098725

§ 371 (c)(1),
(2) Date: Jun. 16, 2017

(87) PCT Pub. No.: WO2016/107492

PCT Pub. Date: Jul. 7, 2016

(65) Prior Publication Data

US 2017/0345354 A1 Nov. 30, 2017

(30) Foreign Application Priority Data

Dec. 30, 2014 (CN) ..... 2014 1 0842032

(51) Int. Cl.
*G09G 3/20* (2006.01)
*G09F 9/30* (2006.01)
*G09G 3/32* (2016.01)

(52) U.S. Cl.
CPC ..... *G09G 3/2003* (2013.01); *G09F 9/30* (2013.01); *G09G 3/32* (2013.01);
(Continued)

(58) Field of Classification Search
CPC ..... G09G 2300/0452; G09G 3/2003
(Continued)

(56) References Cited

U.S. PATENT DOCUMENTS 9,905,788 B2 2/2018 Lee et al.
2003/0071943 A1 4/2003 Choo et al.
(Continued)

FOREIGN PATENT DOCUMENTS

CN 1702721 A 11/2005
CN 1741113 A 3/2006
(Continued)

OTHER PUBLICATIONS

First Office Action by TIPO for parallel Taiwan Patent Application No. 104143773, dated Jul. 13, 2016.
(Continued)

*Primary Examiner* — Tony O Davis
(74) *Attorney, Agent, or Firm* — Platinum Intellectual Property LLP

(57) ABSTRACT

A display is disclosed, including a pixel structure and pixel drive circuits. The pixel structure includes a plurality of pixel groups, each pixel group including two or more pixel units. The pixel unit includes a first sub pixel, a second sub pixel and a third sub pixel. Each of the first sub pixels is connected to a first pixel drive circuit, each of the second sub pixels is connected to a second pixel drive circuit, and all the third sub pixels in one pixel group are connected to a same third pixel drive circuit. A drive method for a display is also disclosed. In the above display and the drive method, a plurality of third sub pixels in one pixel group can be driven by a same third pixel drive circuit based on the same luminance data, which reduces the number of the pixel drive circuits and allows pixel drive of high resolution.

9 Claims, 4 Drawing Sheets

(52) U.S. Cl.
CPC ..... *G09G 2300/0426* (2013.01); *G09G 2300/0452* (2013.01); *G09G 2300/0465* (2013.01); *G09G 2300/08* (2013.01)

(58) Field of Classification Search
USPC ..... 345/82, 84, 87, 690
See application file for complete search history.

(56) References Cited

U.S. PATENT DOCUMENTS

| | | | | |
|---|---|---|---|---|
| 2007/0176862 | A1* | 8/2007 | Kurt | G09G 3/2092 345/82 |
| 2007/0195019 | A1 | 8/2007 | Ono et al. | |
| 2008/0024403 | A1* | 1/2008 | Lai | G09G 3/3688 345/84 |
| 2008/0049048 | A1 | 2/2008 | Credelle et al. | |
| 2009/0262048 | A1* | 10/2009 | Park | G09G 3/006 345/76 |
| 2011/0260951 | A1 | 10/2011 | Hwang et al. | |
| 2011/0260952 | A1 | 10/2011 | Hwang et al. | |
| 2011/0298775 | A1 | 12/2011 | Mori et al. | |
| 2013/0285537 | A1* | 10/2013 | Chaji | H01L 27/322 313/504 |
| 2014/0151658 | A1 | 6/2014 | Lee et al. | |
| 2014/0168041 | A1* | 6/2014 | Chen | G09G 3/3696 345/87 |
| 2014/0333676 | A1* | 11/2014 | Fujii | G09G 3/2003 345/690 |
| 2015/0015468 | A1* | 1/2015 | Ko | G09G 3/3233 345/82 |
| 2015/0364106 | A1* | 12/2015 | Kim | G09G 5/02 345/690 |
| 2016/0012763 | A1* | 1/2016 | Chen | G09G 3/3696 345/690 |
| 2016/0093263 | A1* | 3/2016 | Kimura | G09G 3/3233 345/690 |
| 2017/0243528 | A1* | 8/2017 | Ji | G09G 3/2003 |
| 2017/0285811 | A1* | 10/2017 | Mizuhashi | G06F 3/0412 |
| 2017/0372655 | A1* | 12/2017 | Wang | G09G 3/325 |
| 2018/0107305 | A1* | 4/2018 | Mizuhashi | G06F 3/0412 |

FOREIGN PATENT DOCUMENTS

| | | | |
|---|---|---|---|
| CN | 101271234 | A | 9/2008 |
| CN | 101320150 | A | 12/2008 |
| CN | 103529588 | A | 1/2014 |
| CN | 104464541 | A | 3/2015 |
| JP | 2004507773 | A | 3/2004 |
| JP | 2006525745 | A | 11/2006 |
| JP | 200711063 | A | 1/2007 |
| KR | 2011117613 | A | 10/2011 |
| KR | 2014070168 | A | 6/2014 |
| TW | 200627367 | A | 8/2016 |
| WO | 2007088656 | A1 | 8/2007 |

OTHER PUBLICATIONS

International Search Report and Written Opinion for Application No. PCT/CN2015/098725 dated Mar. 14, 2016.
Search Report & First Office Action by SIPO for Priority Chinese Patent Application No. 201410842032.6, dated Jul. 28, 2016.
Second Office Action by TIPO for parallel Taiwan Patent Application No. 104143773, dated Nov. 29, 2016.
Supplementary Search Report & Second Office Action by SIPO for Priority Chinese Patent Application No. 201410842032.6 dated Mar. 31, 2017.
Extended European Search Report dated May 11, 2018 of the corresponding European patent application No. 15875170.1.
First Office Action (Notice of Grounds for Rejection) for parallel Japanese Patent Application No. 2017-534969, dated Aug. 14, 2018.
First Office Action for parallel Korean Patent Application No. 10-2017-7021125, dated Sep. 14, 2018.

* cited by examiner

DISPLAY AND DRIVE METHOD THEREOF

FIELD

The present disclosure relates to the field of flat-panel display technology, and particularly to a display and a drive method thereof.

BACKGROUND

With the development of technologies, user demand for a display with higher resolution is increasing. PPI (pixels per inch) can be used to measure the display resolution. According to the principle of display, each of the sub pixels in a pixel unit needs to be driven by a pixel drive circuit to emit light. As a result, in addition to accommodating more pixel units per unit area, it is also necessary to arrange more pixel drive circuits in order to improve the pixel resolution.

Take a traditional display with collocated RGB sub pixels for example. To realize a resolution more than 500 ppi, the size of the pixel unit will have to be less than 51×51 (μm), and the size of the sub pixel will have to be less than 17×51 (μm). Considering that the pixel circuit is generally constituted of multiple thin film transistor (TFT) and capacitances (e.g., 6T2C circuit), it is traditionally difficult to manufacture a pixel drive circuit matching the sub pixel having a size less than 17×51 (μm).

SUMMARY

Based on the above, it is necessary to provide a display with reduced number of pixel drive circuits compared with traditional circuits.

Further, a drive method for the display is also provided.

A display includes a pixel structure and pixel drive circuits. The pixel structure includes a plurality of pixel groups, each pixel group including two or more pixel units. A pixel unit includes a first sub pixel, a second sub pixel and a third sub pixel. Each of the first sub pixels is connected to a first pixel drive circuit, each of the second sub pixels is connected to a second pixel drive circuit, and all the third sub pixels in one pixel group are connected to a same third pixel drive circuit.

In one embodiment, the first sub pixel is a red sub pixel, the second sub pixel is a green sub pixel, and the third sub pixel is a blue sub pixel.

In one embodiment, light-emitting layer material of the blue sub pixel is shared by a transport layer or barrier layer of the red sub pixel and that of the green sub pixel.

In one embodiment, the first sub pixels and the second sub pixels in one pixel group are arranged in rows and columns.

In one embodiment, all the third sub pixels in one pixel group are connected with each other.

In one embodiment, the third pixel drive circuit is configured to receive luminance data of all the third sub pixels in one pixel group connected with the third pixel drive circuit, and drive all the third sub pixels based on an average luminance of the luminance data.

In one embodiment, any two of the pixel groups have the same structure.

A drive method for a display includes the steps of:

dividing a pixel structure of the display into a plurality of pixel groups, each pixel group including two or more pixel units, the pixel unit including a first sub pixel, a second sub pixel and a third sub pixel;

connecting each of the first sub pixels to a first pixel drive circuit, connecting each of the second sub pixels to a second pixel drive circuit, each of the first pixel drive circuit and second pixel drive circuit receiving respectively luminance data of the connected first sub pixels and second sub pixels, and driving the first sub pixels and second sub pixels based on the luminance data;

connecting all the third sub pixels in one pixel group to a same third pixel drive circuit, the third pixel drive circuit receiving luminance data of all the connected third sub pixels in the one pixel group, calculating an outputting luminance according a preset rule, and driving all the third sub pixels based on the outputting luminance.

In one embodiment, the preset rule is calculating an average value.

In one embodiment, all the third sub pixels in one pixel group are connected with each other.

In the above display and the drive method thereof, a plurality of third sub pixels in one pixel group can be driven by a same third pixel drive circuit based on the same luminance data, which reduces the number of the pixel drive circuits and allows pixel drive of high resolution.

DETAILED DESCRIPTION OF THE PREFERRED EMBODIMENTS

The embodiments of the disclosure will now be described in detail with reference to the accompany drawings and the embodiments.

Figure 1:
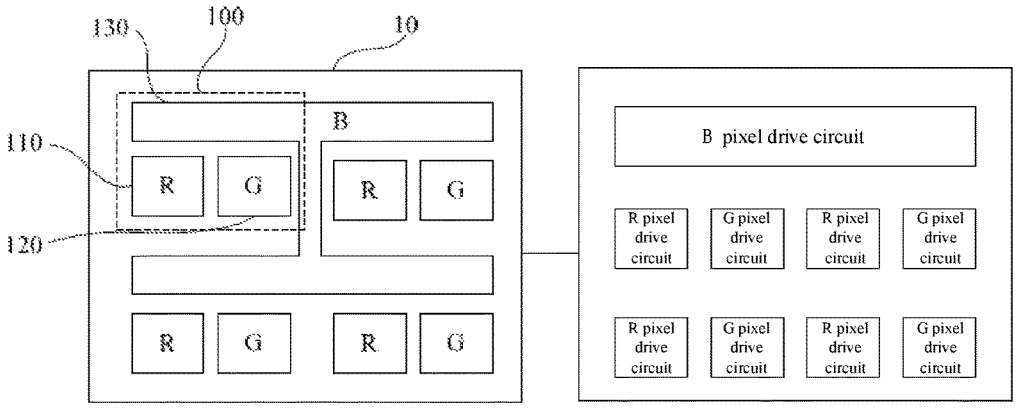
FIG. 1 is a schematic diagram of a structure of a pixel group and the corresponding pixel drive circuits.

A display includes pixel structure and pixel drive circuits. The pixel structure includes a plurality of pixel groups, each pixel group including two or more pixel units. The pixel unit includes a first sub pixel, a second sub pixel and a third sub pixel. The pixel drive circuits includes a plurality of first pixel drive circuits, second pixel drive circuits and third pixel drive circuits. FIG. 1 is a schematic diagram of a structure of a pixel group and the corresponding pixel drive circuits. The pixel group 10 includes four pixel units 100, and each pixel unit 100 includes a first sub pixel 110, a second sub pixel 120 and a third sub pixel 130. Each of the first sub pixel 110 and the second sub pixel 120 is connected respectively to a first pixel drive circuit and a second pixel drive circuit. Meanwhile, all the third sub pixels 130 in the pixel group 10 are connected to a same third pixel drive circuit.

Specifically, as shown in FIG. 1, the first sub pixel 110 is a red sub pixel (R), the second sub pixel 120 is a green sub pixel (G), and the third sub pixel is a blue sub pixel (B). Each of the red sub pixels (R) in the pixel group is connected respectively to an R pixel drive circuit, each of the green sub pixels (G) in the pixel group is connected respectively to a G pixel drive circuit, and all the blue sub pixels (B) are connected to a same B pixel drive circuit. The blue sub pixels (B) can be evaporated using a shadow mask only on the position of the blue sub pixel, or on the whole position of the pixel group, or can be whole surface-evaporated using an open mask on the position of the pixel structure. It is noted that by whichever way the blue sub pixels (B) are evaporated, they are connected by a pixel group to a B pixel drive circuit. That is, all the blue sub pixels (B) in one pixel group are connected to a same B pixel drive circuit.

A drive method for a display includes the steps of:

dividing a pixel structure of the display into a plurality of pixel groups, each pixel group including two or more pixel units, the pixel unit including a first sub pixel, a second sub pixel and a third sub pixel;

connecting each of the first sub pixels to a first pixel drive circuit, connecting each of the second sub pixels to a second pixel drive circuit, each of the first pixel drive circuit and second pixel drive circuit receiving respectively luminance data of the connected first sub pixels and second sub pixels, and driving the first sub pixels and second sub pixels based on the luminance data;

connecting all the third sub pixels in one pixel group to a third pixel drive circuit, the third pixel drive circuit receiving luminance data of the connected third sub pixels, calculating an outputting luminance according a preset rule, and driving all the third sub pixels based on the outputting luminance. Preferably, the preset rule is calculating an average value. That is, all the received luminance data are summed up to calculate an average value, which is used to drive all the third sub pixels 130.

According to the study on the characteristics of the human's point of view, there are three types of cones in human eye, which are sensitive to red light, green light and blue light, respectively. The relative densities of the cones are different, with the number of blue cones (only about 6%) far less than the other two. As a result, the ability of human eye to distinguish colors varies according to different colors. The distinguish angel of blue is about 0.25°, the distinguish angel of red or green is about 0.12°. For example, under the horizon of 30 cm, 0.25° corresponds to a distance of 1270 μm on the display. When the blue pixel spacing is less than half of the distance (i.e., 625 μm), the colors will be mixed without loss of image quality. Thus, even if the resolution of the blue light is reduced by several times, it may not affect the feeling of the human eye for quality. Therefore, according to the insensitiveness of the human eye to blue, it is possible to drive multiple blue sub pixels in the same pixel group with the same pixel drive circuit using the same luminance data, and substantially not lose quality. In this way, the pixel driving circuits may be saved, creating conditions for pixel drive of high resolution.

Furthermore, light-emitting layer material of the blue sub pixel is shared by a transport layer or barrier layer of the red sub pixel and a transport layer or barrier layer of the green sub pixel. Thereby it is possible to further utilize the space in the display to improve the pixel resolution.

Furthermore, the first sub pixels 110 and the second sub pixels 120 in the pixel group 10 are arranged in rows and columns. For example, 4 pixel units 100 includes 4 of the first sub pixels 110 and 4 of the second sub pixels 120, and the 8 sub pixels can form a arrangement of 2×4 as shown in FIG. 1. The third sub pixel 130 does not need to be in a fixed position, as long as it constitutes a complete pixel unit 100 with the corresponding first sub pixel 110 and 4 of the second sub pixels 120 to display colors.

Furthermore, all the third sub pixels 130 in the pixel group 10 may be connected with each other, or may be separated from each other, or may be a single surface.

To facilitate manufacturing, any two of the pixel groups of the display have the same structure.

The pixel structures of a display and the corresponding pixel drive circuits together with the drive method of the display are described in detail with reference to several pixel structures as examples.

Figure 2:
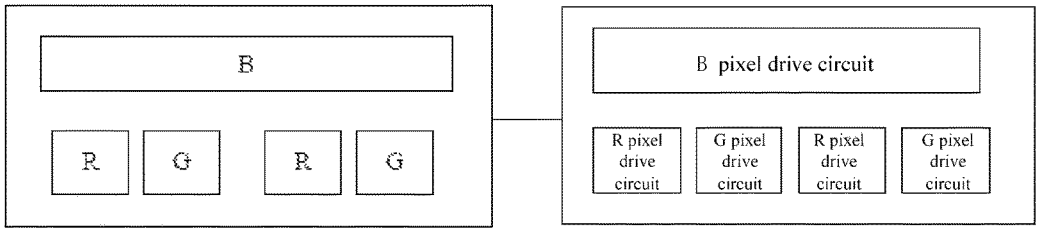
FIG. 2 is a schematic diagram of a structure of a pixel group and the corresponding pixel drive circuits according to a first embodiment.
Figure 3A:
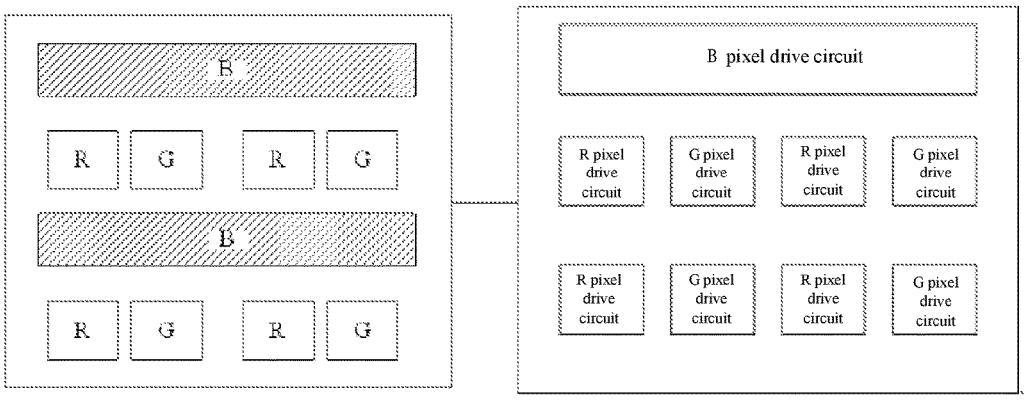
FIG. 3(*a*)-3(*d*) are schematic diagrams of structures of four pixel groups and the corresponding pixel drive circuits according to a second embodiment.
Figure 3B:
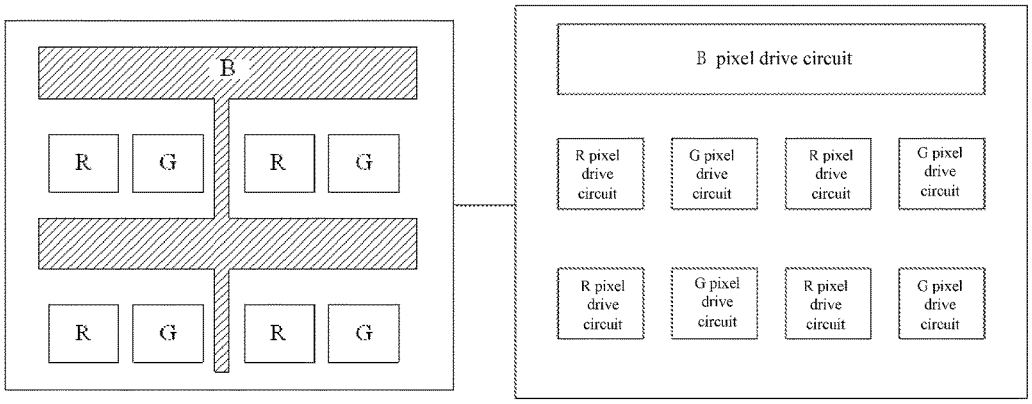
Figure 3C:
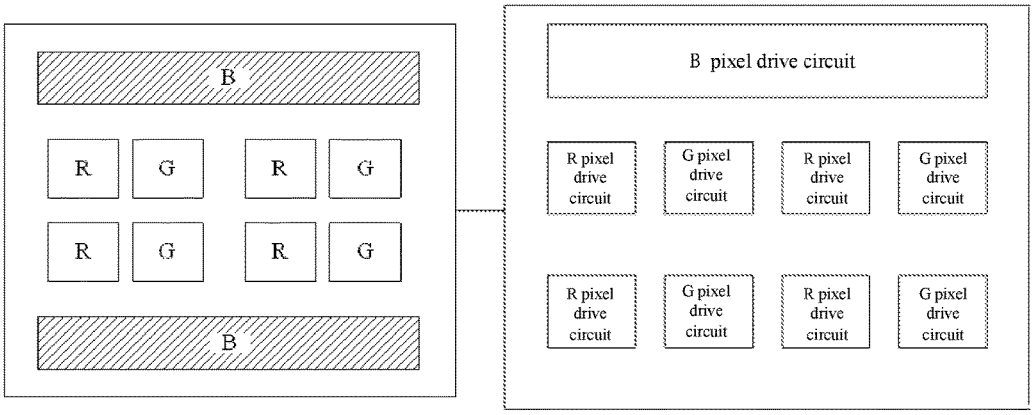
Figure 3D:
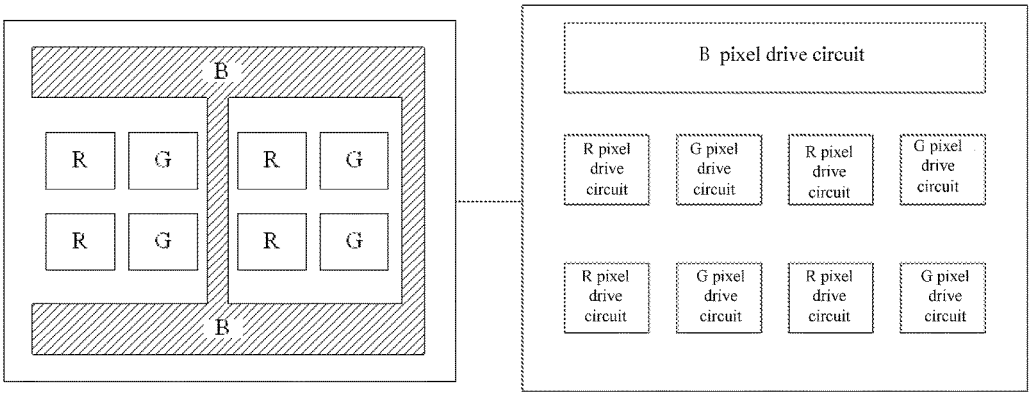

FIG. 2 shows a pixel structure and corresponding pixel drive circuits of a first embodiment. In a pixel group, there are 2 red sub pixels and 2 green sub pixels. Each of the red sub pixels and green sub pixels corresponds to a pixel drive circuit (e.g. 6T1C circuit). The number and positions of the blue sub pixels are not fixed, as long as there is one blue sub pixel for a pair of a red sub pixel and a green sub pixel to constitute a pixel unit. In the embodiment, all the blue sub pixels of one pixel group are connected together. It can be understood that the blue sub pixels of one pixel group may not be connected together, but are individually evaporated in pixel units. Regardless of the arrangement of the blue sub pixels, all the blue sub pixels in different positions in the pixel group are connected to one pixel drive circuit via anode. There are 5 pixel drive circuits in the pixel group, less by 1 pixel drive circuit than the configuration of traditional collocated RGB pixels where there are 6 pixel drive circuits.

The pixel structure of the embodiment includes a plurality of pixel groups as described above, and a display including the above pixel structure and pixel drive circuits are provided in the embodiment.

In this embodiment, a drive method for a display is provided, including the steps of:

dividing a pixel structure of the display into a plurality of pixel groups, each pixel group including two pixel units, the pixel unit including a red sub pixel, a green sub pixel and a blue sub pixel;

connecting each of the red sub pixels to a red pixel drive circuit, connecting each of the green sub pixels to a green pixel drive circuit, each of the red pixel drive circuit and green pixel drive circuit receiving respectively luminance data of the connected red sub pixels and green sub pixels, and driving the red sub pixels and green sub pixels based on the luminance data;

connecting all the blue sub pixels in one pixel group to a blue pixel drive circuit, the blue pixel drive circuit receiving luminance data of the connected blue sub pixels, calculating an outputting luminance according a preset rule, and driving all the blue sub pixels based on the outputting luminance. Preferably, the preset rule is calculating an average value. That is, all the received luminance data are summed up to calculate an average value, which is used to drive all the blue sub pixels.

FIGS. 3(*a*)-3(*d*) show pixel structures of four types of pixel groups and corresponding pixel drive circuits of a second embodiment. In the embodiment, as shown in FIGS. 3(*a*)-3(*d*), in a pixel group there are 4 pixel units. That is, in a pixel unit there are 4 red sub pixels and 4 green sub pixels. Each of the red sub pixels and green sub pixels corresponds to a pixel drive circuit (e.g. 6T1C circuit). The number and positions of the blue sub pixels are not fixed, as long as there is one blue sub pixel for a pair of a red sub pixel and a green sub pixel to constitute a pixel unit. In the embodiment, all the blue sub pixels of one pixel group are connected together. It can be understood that the blue sub pixels of one pixel group may not be connected together, but are individually evaporated in pixel units, or are whole surface-evaporated in pixel groups.

FIGS. 3(*a*)-3(*d*) show cases when the blue sub pixels have four different positions and numbers. In FIGS. 3(*a*) and 3(*c*), there are two blue sub pixels independent from each other, each blue sub pixel matches two pairs of red sub pixel and green sub pixel arranged in a row. Regardless of the arrangement of the blue sub pixels, all the blue sub pixels in different positions in the pixel group are connected to one pixel drive circuit via anode. In FIGS. 3(*b*) and 3(*d*) there are two blue sub pixels connected with each other, which are formed by connecting the independent blue sub pixels in different positions based on the structure of FIG. 3(*a*) or 3(*c*). The connection portion can be made of the material of the blue sub pixel. There are 9 pixel drive circuits in the pixel group, less by 3 pixel drive circuits than the configuration of traditional collocated RGB pixels where there are 12 pixel drive circuits.

The pixel structure of the present embodiment includes a plurality of pixel groups as described above, and a display including the above pixel structure and pixel drive circuits are provided in the embodiment.

In this embodiment, a drive method for a display similar to that of the first embodiment is provided, which will not be repeated herein.

Figure 4:
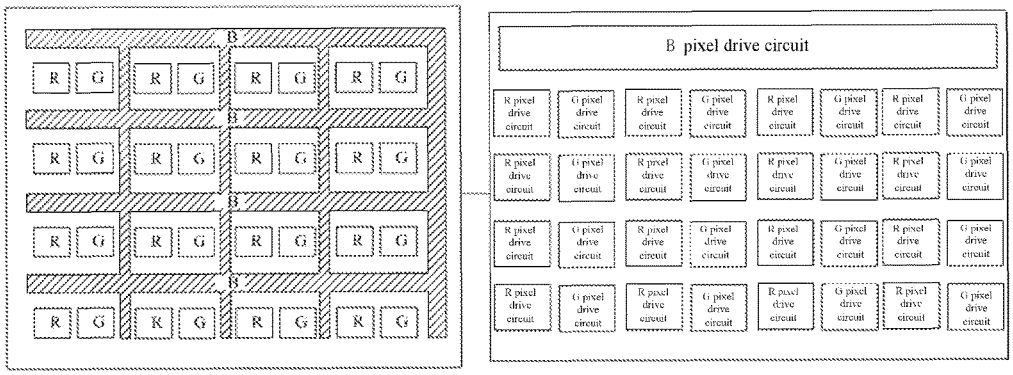
FIG. 4 is a schematic diagram of a structure of a pixel group and the corresponding pixel drive circuits according to a third embodiment.

FIG. 4 shows pixel structure of a pixel group and corresponding pixel drive circuits of a third embodiment. In the pixel group of the embodiment, there are more pixel units. As shown in FIG. 4, in a pixel unit there are 16 red sub pixels and 16 green sub pixels. Each of the red sub pixels and green sub pixels corresponds to a pixel drive circuit (e.g. 6T1C circuit). The number and positions of the blue sub pixels are not fixed, as long as there is one blue sub pixel for a pair of a red sub pixel and a green sub pixel to constitute a pixel unit. In the embodiment, all the blue sub pixels of one pixel group are connected together. It can be understood that the blue sub pixels of one pixel group may not be connected together, but are individually evaporated in pixel units, or are whole surface-evaporated in pixel groups. Regardless of the arrangement of the blue sub pixels, all the blue sub pixels in different positions in the pixel group are connected to a same pixel drive circuit via anode. There are 33 pixel drive circuits in the pixel group, less by 15 pixel drive circuits than the configuration of traditional collocated RGB pixels where there are 48 pixel drive circuits.

The pixel structure of the embodiment includes a plurality of pixel groups as described above, and a display including the above pixel structure and pixel drive circuits are provided in the embodiment.

In this embodiment, a drive method for a display similar to that of the first embodiment is provided, which will not be repeated herein.

It can be understood that there are n red sub pixels and n green sub pixels in one pixel group, in which n can be an integral larger than 1. Thus, it is possible to reduce by n−1 pixel drive circuits than the configuration of traditional collocated RGB pixels.

In the embodiments and drawings, the technical scheme is illustrated in which the first sub pixel is red sub pixel, the second sub pixel is green sub pixel, and the third sub pixel is blue sub pixel. However, the present invention is not limited thereto. For example, the first sub pixel can be green or blue sub pixel, the second sub pixel can be red or blue sub pixel, and the third pixel can be red or green sub pixel.

In summary, in the above display and the drive method thereof, a plurality of third sub pixels in one pixel group can be driven by the same pixel drive circuit based on the same luminance data, which reduces the number of the pixel drive circuits and allows pixel drive of high resolution.

The above are embodiments of the invention described in detail, and should not be deemed as limitations to the scope of the present invention. It should be noted that variations and improvements will become apparent to those skilled in the art to which the present invention pertains without departing from its spirit and scope. Therefore, the scope of the present disclosure is defined by the appended claims.

The invention claimed is:

1. A display, comprising:

a pixel structure and pixel drive circuits, the pixel structure including a plurality of pixel groups, each pixel group including two or more pixel units, and the pixel unit including a first sub pixel, a second sub pixel and a third sub pixel, wherein each of the first sub pixels is connected to a first respective pixel drive circuit, each of the second sub pixels is connected to a second respective pixel drive circuit, and all the third sub pixels in one pixel group are connected to a shared third pixel drive circuit, wherein the shared third pixel drive circuit is configured to receive luminance data of all the third sub pixels in one pixel group connected with the shared third pixel drive circuit, and drive all the third sub pixels based on an average luminance of the luminance data; and wherein the first sub pixel is a red sub pixel, the second sub pixel is a green sub pixel, and the third sub pixel is a blue sub pixel; and light-emitting layer material of the blue sub pixel is shared by a transport layer or barrier layer of the red sub pixel and that of the green sub pixel.

2. The display of claim 1, wherein light-emitting layer material of the blue sub pixel is shared by a transport layer or barrier layer of the red sub pixel and that of the green sub pixel.

3. The display of claim 1, wherein the first sub pixels and the second sub pixels in one pixel group are arranged in rows and columns.

4. The display of claim 1, wherein all the third sub pixels in one pixel group are connected with each other.

5. The display of claim 1, wherein any two of the pixel groups have the same structure.

6. A drive method for a display, comprising:

dividing a pixel structure of the display into a plurality of pixel groups, each pixel group including two or more pixel units, each of the pixel units including a first sub pixel, a second sub pixel and a third sub pixel;

connecting each of the first sub pixels to a first respective pixel drive circuit, connecting each of the second sub pixels to a second respective pixel drive circuit, each of the first respective pixel drive circuit and second respective pixel drive circuit receiving respectively luminance data of the connected first sub pixels and second sub pixels, and driving the first sub pixels and second sub pixels based on the luminance data;

connecting all the third sub pixels in one pixel group to a shared third pixel drive circuit, the shared third pixel drive circuit receiving luminance data of all the connected third sub pixels in the one pixel group, calculating an outputting luminance according a preset rule, and driving all the third sub pixels based on the outputting luminance;

wherein the first sub pixel is a red sub pixel, the second sub pixel is a green sub pixel, and the third sub pixel is a blue sub pixel; and light-emitting layer material of the blue sub pixel is shared by a transport layer or barrier layer of the red sub pixel and that of the green sub pixel.

7. The method of claim 6, wherein the preset rule is calculating an average value.

8. The method of claim 6, wherein all the third sub pixels in the one pixel group are connected with each other.

9. A display, comprising:

a pixel structure and pixel drive circuits, the pixel structure including a plurality of pixel groups, each pixel group including two or more pixel units, and the pixel unit including a first sub pixel, a second sub pixel and a third sub pixel, wherein each of the first sub pixels is connected to a first respective pixel drive circuit, each of the second sub pixels is connected to a second respective pixel drive circuit, and all the third sub pixels in one pixel group are connected to a shared third pixel drive circuit, wherein the shared third pixel drive circuit is configured to receive luminance data of all the third sub pixels in one pixel group connected with the shared third pixel drive circuit, and drive all the third sub pixels based on an average luminance of the luminance data;

wherein all the third sub pixels in the one pixel group are connected with each other; and wherein the first sub pixel is a red sub pixel, the second sub pixel is a green sub pixel, and the third sub pixel is a blue sub pixel; and light-emitting layer material of the blue sub pixel is shared by a transport layer or barrier layer of the red sub pixel and that of the green sub pixel.

* * * * *